United States Patent [19]

Itagaki et al.

[11] Patent Number: 4,675,907

[45] Date of Patent: Jun. 23, 1987

[54] ELECTRO-VIBRATION TRANSDUCER

[75] Inventors: Tadashi Itagaki; Hidehito Gomi; Masahiko Komatsubara, all of Saitama, Japan

[73] Assignee: Pioneer Electronic Corporation, Tokyo, Japan

[21] Appl. No.: 753,469

[22] Filed: Jul. 10, 1985

[30] Foreign Application Priority Data

Jul. 10, 1984 [JP] Japan ..... 59-143065

[51] Int. Cl.[4] ..... H04R 9/06

[52] U.S. Cl. ..... 381/152; 381/158; 381/90

[58] Field of Search ..... 381/86, 87, 88; 179/181 W, 113, 114 M; 181/150, 166

[56] References Cited

U.S. PATENT DOCUMENTS 2,256,270 9/1941 Swift ..... 181/166
3,074,504 1/1963 Trautman ..... 181/166
4,131,180 12/1978 Maeda ..... 181/166
4,354,067 10/1982 Yamada ..... 179/181 W
4,506,117 3/1985 Fresard ..... 181/150
4,550,428 10/1985 Yanagishima ..... 179/181 W

FOREIGN PATENT DOCUMENTS 484872 2/1929 Fed. Rep. of Germany ..... 179/181 W

*Primary Examiner*—Gene Z. Rubinson
*Assistant Examiner*—L. C. Schroeder
*Attorney, Agent, or Firm*—Sughrue, Mion, Zinn, Macpeak, and Seas

[57] ABSTRACT

An electro-vibration transducer for converting sound signals into body-sensible acoustic vibrations to permit the listener to sense sound directly through his or her body and having a wide effective bandwidth and good transient response characteristic. An auxiliary vibrator, namely, a weight, is attached to a magnetic circuit of the transducer via an elastic member. The auxiliary vibrator can be attached to an outer annular surface of the magnetic circuit, or to a lower planar surface thereof. Preferably, the elastic member is made of a visco-elastic material.

5 Claims, 9 Drawing Figures

ELECTRO-VIBRATION TRANSDUCER

BACKGROUND OF THE INVENTION

The present invention relates to electro-vibration transducers, and more particularly to an electro-vibration transducer employed as a vibrating source for a body-sensible acoustic vibration device.

A body-sensible acoustic vibration device has a special electro-vibration transducer which converts sound signals from an acoustic device such as a loudspeaker and also low-frequency sounds in a frequency range lower than the audio frequency range into mechanical vibrations of a member with which the body of the listener is in contact, thereby allowing the listener to sense the sounds directly through his or her body as if he or she were present at a live performance.

There have been proposed in the art a variety of electro-vibration transducers. One example of such a transducer is shown in FIG. 1. The transducer is installed on the frame of a chair, for instance.

The electro-vibration transducer has a cylindrical case 1 made of resin with both ends closed. An annular magnet 2 is arranged in the case 1 and secured to the latter with a damper 3 made of a leaf spring material or the like. An annular yoke plate 4 and a yoke 5 are coaxially secured to respective upper and lower surfaces of the magnet 2. The yoke 5 has a pole 5*a* extending from its center. The pole 5*a*, the magnet 2 and the annular yoke plate 4 form a magnetic gap 6. A cylindrical bobbin 8 is inserted into the magnetic gap 6 and is fixedly secured to a closed end 1*a* of the case 1. A voice coil 9 is wound on the outer cylindrical wall of the bobbin 8.

In the electro-vibration transducer thus constructed, the damper 3 is made of a material such as a leaf spring material having a small internal loss. Therefore, the resonance sharpness Q at the low resonance frequency $f_0$ is large, as indicated by the solid line in FIG. 2, with the result that the effective bandwidth of the device is narrow and its transient response is poor.

In order to overcome these difficulties, a variety of methods have been employed. Among these are methods of improving the transducer by providing a visco-elastic member between the case 1 and the magnetic circuit, filling the magnetic gap 6 with magnetic fluid, and employing a compound member as the damper 3. These improvements can succeed in decreasing the resonance sharpness, as indicated by the broken line 10*b* in FIG. 2, thus increasing the effective bandwidth and improving the transient response. However, the resulting effective bandwidth is still not wide enough.

In order to eliminate the above-described difficulties accompanying the transducer shown in FIG. 1, an electro-vibration transducer as shown in FIG. 3 has been proposed. As is apparent from FIG. 3, the transducer is formed by adding a magnetic circuit and a voice coil to the electro-vibration transducer shown in FIG. 1. The magnetic circuit is composed of a magnet 12 secured through a damper 11 to the case 1, and an annular yoke plate 14 and a yoke 15 fixedly secured to the magnet 12. A bobbin 18 on which the voice coil 19 is wound is inserted into a magnetic gap 16 formed in the magnetic circuit. In FIG. 3, those components which correspond to similar components in FIG. 1 are designated by the same reference numerals.

This transducer is so designed that, as shown in FIG. 4, the low resonance frequencies of the two driver units, namely, the magnetic circuits, are set to suitable values $f_{01}$ and $f_{02}$ so that the effective bandwidth is sufficiently widened with the bandwidth between the two values $f_{01}$ and $f_{02}$ acting as an apparent passband. However, since the transient response cannot be improved without decreasing the resonance sharpness at the low resonance frequencies, the same improvements effected to the transducer shown in FIG. 1 can be applied to the transducer shown in FIG. 3, for instance, the magnetic gaps 6 and 16 can be filled with magnetic fluid.

With this electro-vibration transducer, a sufficiently wide effective bandwidth and a satisfactory transient response can be obtained. However, the transducer suffers from a difficulty that the leakage flux of the two magnetic circuits affects the vibration response of the magnetic circuits, making it nonlinear.

SUMMARY OF THE INVENTION

In view of the foregoing, an object of the present invention is to provide an electro-vibration transducer which has a sufficiently wide effective bandwidth and a satisfactory transient response, and which provides a linear vibration response at all times.

In accordance with the above and other objects, the invention provides an electro-vibration transducer including a magnetic circuit, a voice coil provided in the magnetic circuit, and an auxiliary vibrator mounted through an elastic member on the magnetic circuit.

DESCRIPTION OF THE PREFERRED EMBODIMENTS

Preferred embodiments of the invention will be described with reference to FIGS. 5 through 7.

Figure 1:
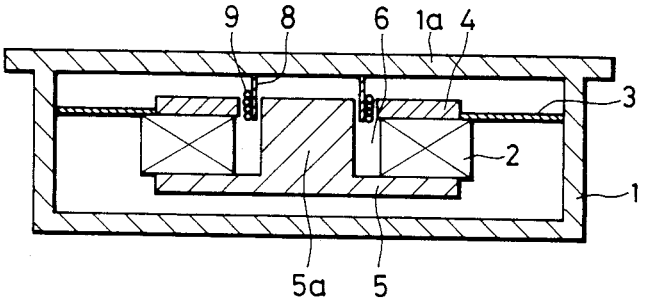
FIG. 1 PRIOR ART
FIG. 1 is a cross-sectional view showing a conventional electro-vibration transducer.
Figure 2:
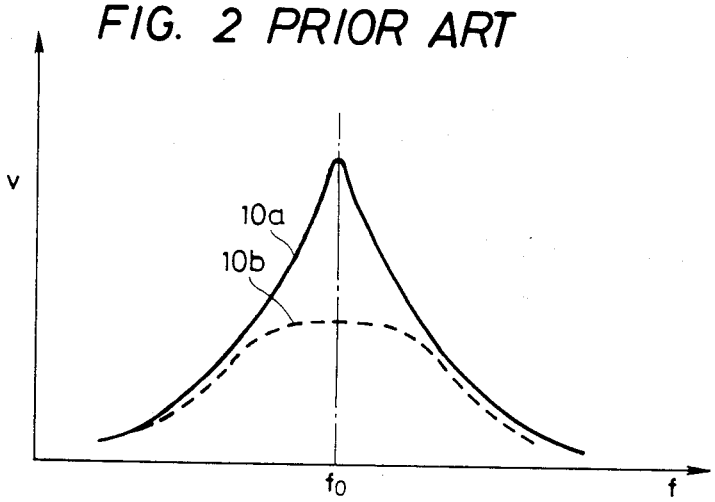
FIG. 2 PRIOR ART
FIG. 2 is a graph showing a resonance curve of the transducer of FIG. 1.
Figure 3:
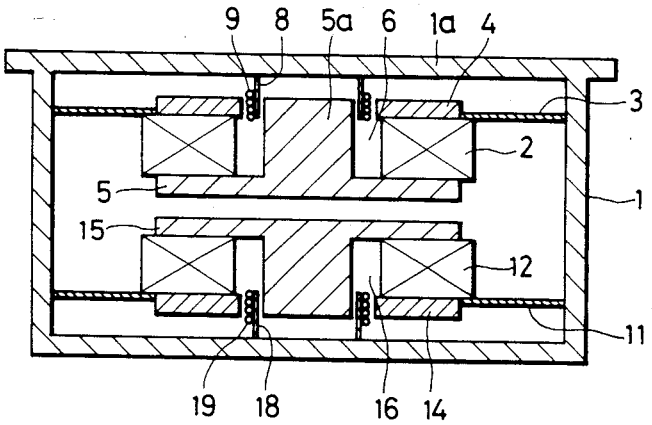
FIG. 3 PRIOR ART
FIG. 3 is a cross-sectional view of another conventional electro-vibration transducer.
Figure 4:
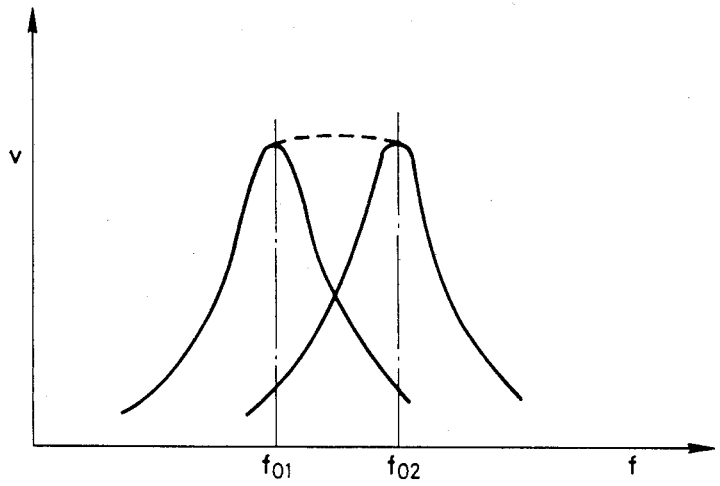
FIG. 4 PRIOR ART
FIG. 4 is a graph showing a resonance characteristic of the transducer of FIG. 3.
Figure 5:
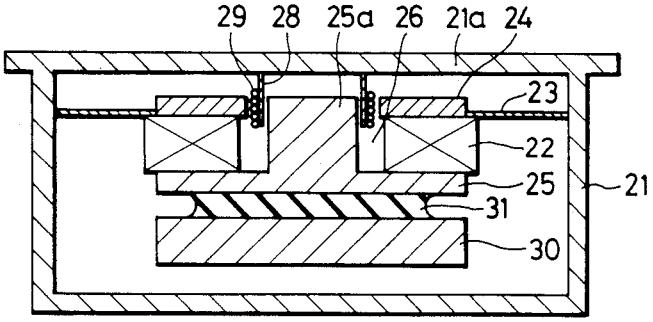
FIG. 5 is a cross-sectional view of an electro-vibration transducer constructed in accordance with a first preferred embodiment of the invention.

FIG. 5 shows an electro-vibration transducer constructed in accordance with a first embodiment of the invention.

As shown in FIG. 5, the transducer has a cylindrical case 21 with both ends closed. The case 21 is made of resin or the like. An annular magnet 22, arranged in the case 21, is secured to the inner wall of the case 21 with a damper 23 made of a leaf spring material, for instance. An annular yoke plate 24 and a yoke 25 are coaxially secured to the upper and lower surfaces of the magnet 22. The annular yoke plate 24, the yoke 25 and the annular magnet 22 form a magnetic circuit. The yoke 25 has a pole 25*a* protruding from its center. The pole, the annular magnet 22 and the annular yoke plate 24 form a magnetic gap 26. A bobbin 28 secured to a closed end 21*a* of the case 21 is inserted into the magnetic gap 26. A voice coil 29 is wound on the cylindrical outer wall of the bobbin 28. An auxiliary vibrator, namely, a weight 30, is secured through an elastic member 31 to the main surface of the yoke 25, which is one of the components of the magnetic circuit.

The mechanical impedance of the transducer is determined by the way in which the case is mounted, for instance, on the arm of a chair. When mounted in such a manner, the voice coil is secured fixedly to the case and held stationary, and the magnetic circuit including the annular magnet 22 vibrated as a driver unit.

In the transducer, the low resonance frequency $f_0$ is determined by the stiffness S of the elastic member 31 and the mass m of the weight 30 as follows:

$$f_0 = \frac{1}{2\pi}\sqrt{\frac{S}{m}}$$

Figure 6A:
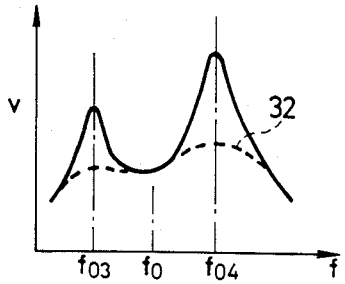
FIGS. 6A through 6C are graphs showing resonance characteristics of the transducer of FIG. 5.

FIG. 6A shows the speed response curve of the electro-vibration transducer of the invention. As is apparent from this curve, for frequencies much lower than $f_0$, vibration is effected under the condition that equivalently the mass of the weight 30 is added directly to the mass of the magnetic circuit, i.e., the elastic member 31 is substantially eliminated, and therefore a low resonance frequency $f_{03}$ exists determined by the sum of the masses of the magnetic circuit and the weight 30 and the stiffness of the damper 23. On the other hand, for frequencies much higher than $f_0$, vibration is effected under the condition that equivalently, with respect to the magnetic circuit, the stiffness of the elastic member 31 is added to the stiffness of the damper 23, and therefore a low resonance frequency $f_{04}$ exists determined by the sum of the stiffnesses of the elastic member 31 and the damper 23 and the mass of the magnetic circuit.

That is, two low resonance frequencies are obtained as described above. Therefore, the effective bandwidth can be widened with the band between the two low resonance frequencies acting as an apparent bandwidth.

If the mass of the weight 30 (or the auxiliary vibrator) and the stiffness of the elastic member 31 are suitably changed, then the sharpness of the resonance curve at each of the low resonance frequencies can be decreased and the transient response thus improved.

Figure 6B:
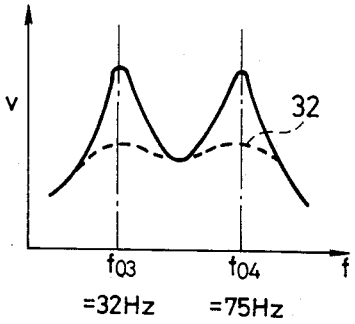
Figure 6C:
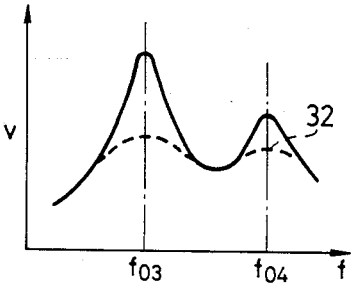

FIG. 6A shows the speed response curve for the case where the transducer is designed so that the low resonance frequency determined by the mass of the weight 30 and the stiffness of the elastic member 31 is lower than that determined by the mass of the magnetic circuit and the stiffness of the damper 23, FIG. 6B shows the speed response curve for the case where the transducer is designed so that the two low resonance frequencies are substantially equal to each other, and FIG. 6C shows the speed response curve for the case where the transducer is designed so that the low resonance frequency determined by the mass of the weight 30 and the stiffness of the elastic member 31 is higher than that determined by the mass of the magnetic circuit and the stiffness of the damper 23.

In the above-described electro-vibration transducer, the elastic member 31 is made of a visco-elastic material such as rubber. Employment of a visco-elastic material, which can be relatively easily molded and which can be obtained at a relatively low price, makes it possible to manufacture the elastic member at low cost. Instead of the visco-elastic material, a coil spring may be employed as the elastic member 31. In the latter case, the stiffness of the elastic member can be set accurately.

Figure 7:
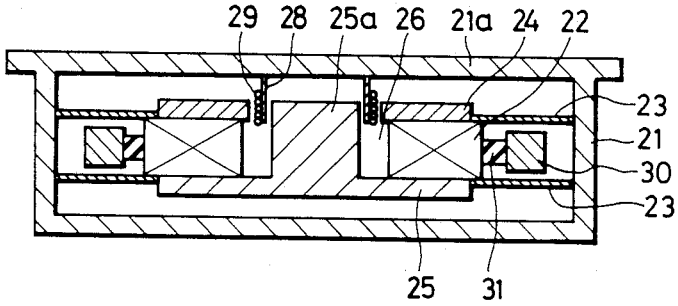
FIG. 7 is a cross-sectional view of an electro-vibration transducer constructed in accordance with a second embodiment of the invention.

FIG. 7 shows an electro-vibration transducer constructed in accordance with a second embodiment of the invention. This transducer has a damper 23 used to prevent a "rolling" phenomenon which occurs when the transducer produces large amplitude vibrations. As is apparent from FIG. 7, a weight 30 is secured through an elastic member 31 to the outer wall of an annular magnet 22. The transducer thus constructed has the same effects as the transducer shown in FIG. 5, and it can be readily reduced in thickness compared with that shown in FIG. 5. In FIG. 7, components functionally equivalent to or corresponding to those already described with reference to FIG. 5 are designated by the same reference numerals or characters. Furthermore, in the second embodiment, components other than those described above are constructed completely in the same manner as those in the first embodiment.

In each of the above-described first and second embodiments, the auxiliary vibrator is provided on the side of the magnetic circuit. However, the transducers may be modified so that the side of the voice coil is employed as the driver unit and the vibrator is provided on the side of the voice coil.

As is apparent from the above description, in the electro-vibration transducer according to the invention, the auxiliary vibrator is secured through the elastic member to the vibrating side, namely, the side of the magnetic circuit on the side of the voice coil, with the result that two low resonance frequencies are obtained. Therefore, the effective bandwidth of the transducer can be sufficiently widened with the bandwidth between the two low resonance frequencies forming an apparent band.

Furthermore, in the electro-vibration transducer according to the invention, by suitably selecting the mass of the auxiliary vibrator and the stiffness of the elastic member, the sharpness of the resonance curve at each of the two low resonance frequencies can be decreased, and therefore an excellent transient response can be obtained.

Only one magnetic circuit is required in the electro-vibration transducer of the invention. Therefore, no problem is involved, as in the conventional electro-vibration transducer having two magnetic circuits, of the vibrations of the magnetic circuits being affected by leakage flux. Accordingly, the transducer of the invention provides stable and linear vibration at all times.

We claim:

1. An electro-vibration transducer, comprising:

a case;

a magnetic circuit;

a flexible damper connecting said magnetic circuit to said case;

a voice coil inserted in a magnetic gap of said magnetic circuit;

an auxiliary vibrator; and an elastic member coupling said auxiliary vibrator to said magnetic circuit.

2. The electro-vibration transducer as claimed in claim 1, wherein said elastic member is made of a visco-elastic material.

3. The electro-vibration transducer as claimed in claim 1, wherein said magnetic circuit comprises: an annular yoke plate, a yoke member having a cylindrically shaped central pole portion forming said magnetic gap with an inner edge of said annular yoke plate and a disc-shaped portion disposed opposite said annular yoke plate, and an annular magnet received between said annular yoke plate and said disc-shaped portion.

4. The electro-vibration transducer as claimed in claim 3, wherein said auxiliary vibrator comprises a disc-shaped weight, and wherein said elastic member couples said auxiliary vibrator to an outer surface of said disc-shaped portion of said yoke member.

5. The electro-vibration transducer as claimed in claim 3, wherein said auxiliary vibrator comprises an annularly shaped weight, and wherein said elastic member couples said auxiliary vibrator to an outer surface of said annularly shaped magnet.

* * * * *